US007047621B2

(12) United States Patent
Zajber et al.

(10) Patent No.: US 7,047,621 B2
(45) Date of Patent: May 23, 2006

(54) METHOD FOR CASTING AND IMMEDIATE ROLLING, AND DEVICE FOR THE SUPPORT, GUIDANCE AND DEFORMATION OF A METAL STRAND, ESPECIALLY IN STEEL STRAND

(75) Inventors: Adolf Zajber, Langenfeld (DE); Thomas Fest, Duisburg (DE)

(73) Assignee: SMS Demag AG, Dusseldorf ( * ) Notice: Subject to any disclaimer, the term of this patent is extended or adjusted under 35 U.S.C. 154(b) by 0 days.

(21) Appl. No.: 10/450,769

(22) PCT Filed: Dec. 1, 2001

(86) PCT No.: PCT/EP01/14068

§ 371 (c)(1),
(2), (4) Date: Nov. 24, 2003

(87) PCT Pub. No.: WO02/47849

PCT Pub. Date: Jun. 20, 2002

(65) Prior Publication Data

US 2004/0216300 A1 Nov. 4, 2004

(30) Foreign Application Priority Data

Dec. 16, 2000 (DE) ..... 100 62 868

(51) Int. Cl.
*B21B 1/46* (2006.01)

(52) U.S. Cl. ..... 29/527.7; 29/33 C; 72/225; 72/226; 72/252.5

(58) Field of Classification Search ..... 29/33 C, 29/572.7; 72/224, 225, 226, 252.5; 164/332, 164/442

See application file for complete search history.

(56) References Cited

U.S. PATENT DOCUMENTS 3,347,076 A * 10/1967 Noda et al. ..... 72/201
3,538,732 A * 11/1970 Goro et al. ..... 72/226
4,550,582 A * 11/1985 Ehiro et al. ..... 72/234
4,640,338 A 2/1987 Kumagai (Continued)

FOREIGN PATENT DOCUMENTS

EP 450391 * 10/1991

(Continued)

OTHER PUBLICATIONS

JP 04-210850 Derwent English Abstract. Derwent 1992.*

(Continued)

*Primary Examiner*—Eric Compton
(74) *Attorney, Agent, or Firm*—Abelman, Frayne & Schwab

(57) ABSTRACT

A method for casting and rolling preliminary sections, especially H-sections, and a device for the support, guidance and deformation of a metal strand, especially a steel cast strand (1), in a continuous casting installation for preliminary sections with soft reduction (9), wherein roll carriers (2) are arranged below the continuous casting mold opposite each other on each side of the cast strand (1*a*, 1*b*), the rolls of said carriers being in transport and/or deformation connection with said cast strand, and wherein to avoid segregation and porosity, the preliminary section is precast in the continuous casting mould with a bulge (6*a*) on the flanges (7) on the surface (6*b*) of the web of said preliminary section, and the bulges (6*a*) of the flange (7) and the web of the preliminary section (6) are rolled flat in the soft reduction area (9) in such a way that the outer surfaces of the flange (7*a*) and the web surfaces of the preliminary section (6*b*) are largely plane.

11 Claims, 1 Drawing Sheet

U.S. PATENT DOCUMENTS

| | | | | |
|---|---|---|---|---|
| 5,238,047 | A | | 8/1993 | Sakata |
| 5,460,220 | A | * | 10/1995 | Coassin ..... 164/483 |
| 5,970,773 | A | * | 10/1999 | Engel et al. ..... 72/251 |

FOREIGN PATENT DOCUMENTS

| | | | |
|---|---|---|---|
| GB | 2105229 | | 3/1983 |
| JP | 58-112602 | * | 7/1983 |
| JP | 02-034202 | * | 2/1990 |
| JP | 04-210850 | * | 7/1992 |
| JP | 10-109101 | * | 4/1998 |

OTHER PUBLICATIONS

Patent Abstract of Japan, JP-04210850 Jul. 1992.

* cited by examiner

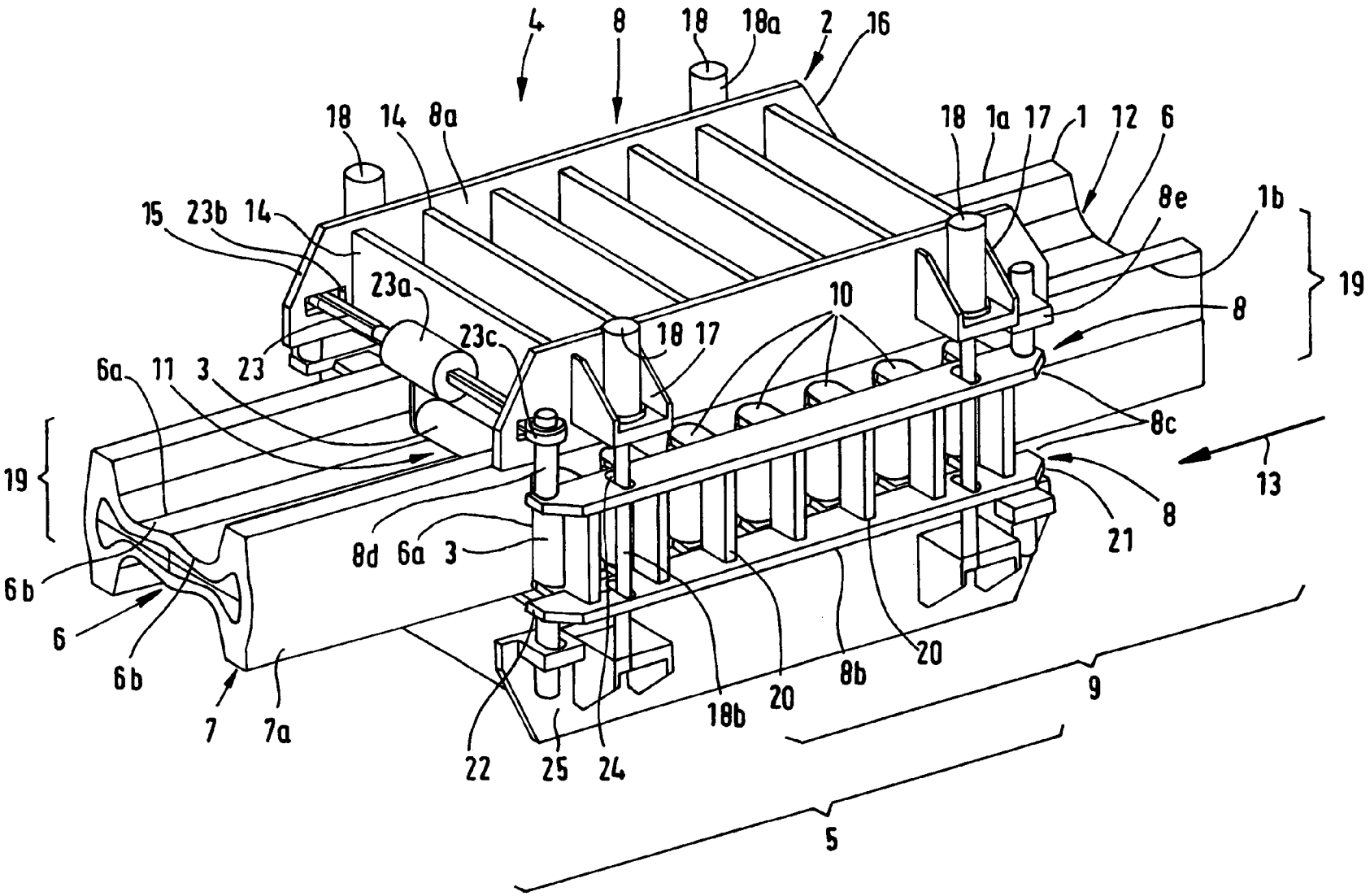
19
1b
8
13
8e
6
12
1
17
1a
18
8c
8
21
9
5
16
2
18a
18
8
4
10
20
8b
20
18b
18 17
24
25
22
3
6a
8d
23c
23a
8a
14
18
14
23b
15
23
3
11
6a
6b
6
19
6b
7a
7

METHOD FOR CASTING AND IMMEDIATE ROLLING, AND DEVICE FOR THE SUPPORT, GUIDANCE AND DEFORMATION OF A METAL STRAND, ESPECIALLY IN STEEL STRAND

BACKGROUND OF THE INVENTION

1. Field of the Invention

The invention relates to a method of casting and immediate rolling and a device for the support, guidance, and deformation of a metal strand, especially a steel cast strand in a continuous casting installation for preliminary sections with soft reduction, wherein beneath a continuous casting mold, on opposite sides of a cast strand, roll carriers, which are located opposite each other, are respectively arranged and the rolls of which are in transport and/or deformation connection with the cast strand.

2. Description of the Prior Art

The need in high-strength supports necessitates that the mid-plane structure of the web and flanges of an H-support section have a segregation from minimal to none and be porosity-free. To meet these requirements a so-called soft reduction can be used in the region of the lowest point of the liquid pool and/or the solidification region. This method was used, up to the present, in bloom continuous casting installations. In the continuous casting installation for preliminary sections, a preform on the flanges can be superimposed on a cast strand already in a continuous casting mold and later the preform can be superimposed also on the webs in a stand with backup rolls.

EP-0450 391 B1 discloses a device for supporting a metal cast strand, in particular for soft reduction, in a casting installation for a roughed strip, and in which beneath the continuous casting mold, on opposite sides of a cast strand, there are provided roll carriers which are located opposite each other and the rolls of which form an operational connection with the cast strand. Each of the roll carriers is arranged in a stationary frame and is divided in a plurality of roll-carrying segments connected with adjusting devices, with the roll-carrying segments being so hingedly connected with each other that each segment can be separately adjusted and set at an arbitrary angle relative to the cast strand, and with the overall adjustment of the roll carrier being effected by an upper adjustment device. Such an arrangement of hingedly connected with each other, roll carriers, require, however, use of a stationary frame extending over the entire length for absorbing the forces, which is expensive and is required over the entire strand.

An object of the invention is a preliminary section, in particular, a steel H-section, with a rolling process being effected in the soft reduction area, with the associated device having a roller carrier occupying the smallest possible space and having high supporting forces, and with the soft reduction of the preliminary section strands being effected so that the mentioned segregations and porosities do not occur or occur not at the same degree as before.

SUMMARY OF THE INVENTION

The object of the invention is achieved by a method discussed above in which, according to the invention, the preliminary section is precast in a continuous casting mold with a bulge on the flanges and on the surface of the web of the preliminary section, and the bulges of the flange and the web of the preliminary section are rolled flat in the soft reduction area in such a way that the outer surfaces of the flange and the web surfaces of the preliminary section are largely plane. In this way, the segregations and porosities in the web and the flanges oppose each other and, therefore, hardly occur. Advantageously, according to the inventive method the bulges of surfaces of the preliminary section web and of the flange outer surfaces are formed as slightly curved outwardly, arcuate bulges.

The object of the invention is also achieved by a device in which within the strand guide in the solidification region for soft reduction, a plurality of arranged one after another, support and deformation rolls are sectionwise conically adjusted, with respect to the preliminary section web and/or the flanges with an increasing, in a strand displacement direction, force. Thereby, in the soft reduction area, the flanges and the web are so deformed that the segregations are noticeably prevented. Besides, the porosities are eliminated.

According to an embodiment of the invention the bulges on the preliminary section web and/or the flange outer surface, which were precast in the continuous casting mold, in the solidification region for soft reduction, are deformed in a finished preliminary section by a conical adjustment of one or more roll carriers. The desired compactness of the material, together with the elimination of the mid-flange segregations and porosities, is furthered by the high compactness.

The obtaining of a finished preliminary section is achieved according to the invention by forming an angularly adjustable roll frame of a section of a plurality of arranged one after another support and deformation rolls. Thereby, during the adjustment of the roll frame all of the rollers would be adjusted in accordance with the adjustment angle.

An independent adjustment with respect to the flange outer surfaces is obtained by forming, over the length of the soft reduction area, of the support and deformation rolls in the roll frame, adjustable flange roll groups for the cast strand flanges.

Correspondingly, an independent adjustment with respect to the preliminary section web is obtained by forming, over the length of the soft reduction area, of the support and deformation rolls in the roll frame, adjustable web roll groups for the preliminary section of the cast strand.

According to a further improvement of the present invention, a roll frame for the strand upper surface consists of elongate roll frames extending parallel to the strand displacement direction and connected with each other by cross-beams, and in that on the elongate roll frames in the front region and the rear region, respective supports for the deformation effecting elements are provided. Thereby, a compact device capable of handling high adjustment forces is obtained. In addition, there are provided attachment surfaces for the rotary supports the axes of which form axes of the horizontal support and deformation rolls.

Analogous to the improvement of the device discussed above, respective roll frames are formed for the strand narrow sides each consisting of a pair of elongate roll frames extending parallel to the strand upper side and connected with each other pro a cast strand side, by a plurality of cross-beams extending transverse to the strand displacement direction. Thereby, the support and deformation rolls with transverse axes can be easily commonly adjusted with respect to the flange outer surfaces.

The deformation forces are provided by the pairs of parallel, narrow-side roll frames of both strand sides which have their respective ends connected by tie rods extending transverse to the strand displacement direction. The tension force can be precisely adjusted.

The tie rods are formed as controlled hydraulic piston-cylinder units. Thereby, the deformation force can be easily adapted.

Constructively, the connection of the roll frames for the strand upper surface and the strand narrow sides is advantageously achieved by forming the transverse deformation effecting elements of controlled piston-cylinder units the piston rods of which extend through slot-shaped openings of the parallel small side rod frames, and are secured to the base frame.

BRIEF DESCRIPTION OF THE DRAWINGS

The drawing shows and embodiment of the invention that would be described in detail below.

The single FIGURE of the drawing shows a perspective view of the device.

DETAILED DESCRIPTION OF THE PREFERRED EMBODIMENT

A device for supporting, guiding, and deforming a metal strand, in particular a steel cast strand 1 is implemented in a continuous casting installation for preliminary sections, in particular H-sections, with soft reduction, wherein beneath a continuous casting mold (not shown in detail), there are arranged, opposite each other and on opposite sides 1*a* (left strand side) and 1*b* (right strand side) of the cast strand 1, roller carriers 2 support and deformation rolls 3 of which are in transport and/or deformation connection with the cast strand 1 and which form a strand guide 4. Within the strand guide 4, in the solidification region 5 for soft reduction, the support and deformation rolls 3, which are arranged one behind the other, are sectionwise conically adjusted, with respect to a preliminary section web 6 and/or flanges 7, with an increasing deformation force in the displacement direction 13. In the solidification region 5 for soft reduction, the preliminary section, which is cast in the continuous casting mold with the bulges 6*a* on surfaces 6*b* of the preliminary section web and/or an outer surfaces 7*a* of the flanges, is deformed into a finished preliminary section.

The preliminary formed bulges 6*a* are formed by the surfaces 6*b* of the preliminary section web and/or the outer surfaces 7*a* of the flanges 7, which extend to each other so that they form an obtuse angle.

The plurality of the arranged one after another, support and deformation rolls 3 form, on opposite sides 1*a*, 1*b* and on the strand upper surface 12 of the cast strand, conically adjustable roll frames 8. In the roll frames 8, over the length of the soft-reduction area 9, the support and deformation rolls 3 form flange rolling sets 10 that are commonly adjusted relative to the flanges 7 of the cast strand 1. In this way, paired elongate roll frames 8*a* and narrow side roll frames 8*b* are formed. In the same manner, the support and deformation rolls 3 form, in the roll frames 8 over the length of the soft reduction area 9, web rolling groups 11 adjustable relative to the preliminary section web 6 of the cast strand 1.

The roll frames 8 are so formed that the roll frame 8 for the strand upper side 12 is formed of two elongate frames 8*a* which extend parallel to the strand displacement direction 13 and are connected with each other by a plurality of cross-beams 14. In the front region 15 and in the rear region 16 of both elongate roll frames 8*a*, there are provided, respectively, supports 17 for deformation effecting means 18 extending transverse thereto.

Correspondingly, respective roll frames 8*b* are formed for the strand narrow sides 19 and which are formed of extending parallel to the strand upper surface 12, pairs 8*c* of respective elongate roll frames 8*a*. The narrow side roll frames 8*b* are connected with each other by a plurality of spaced cross-beams 20 extending transverse to the strand displacement direction 13. The pairs 8*c* of a parallel small side roll frames 8*b* of the two strand sides 1*a* and 1*b* are connected with each other, at their ends 22, by a tie rod 23 extending transverse to the strand displacement direction 13, with a pivot support 8*e* being provided at an end 21 for the unit of pairs 8*c* with cross-beams 20. Thereby, the units are adjustable in an approximately horizontal plane away from and toward each other. The tie rod 23 is formed of a controlled piston-cylinder unit 23*a*. The tie rod 23 extends through openings 23*b* of both elongate roll frames 8*a* which extend parallel to the strand displacement direction 13. The piston-cylinder units 23*a* are connected with connection rods 8*d* of the narrow side roll frames 8*b* by articulated heads 23*c*.

The transverse deformation effecting means 18, which are likewise formed of controlled piston-cylinder units 18*a*, have their piston rods 18*b* extending through similar slot-shaped openings 24 in the narrow side roll frames 8*b* and hingedly secured in the base frames 25.

List of Reference Numerals

1 Cast strand
1*a* (left) cast strand side
1*b* (right) cast strand side
2 roll carrier
3 support and deformation rolls
4 strand guide
5 solidification region
6 preliminary section web
6*a* bulge
6*b* preliminary section web surfaces
7 flange
7*a* flange outer surface
8 roll frame
8*a* elongate roll frame
8*b* narrow side roll frame
8*c* pair
8*d* connection rod
8*e* pivot support
9 soft reduction area
10 flange roll groups
11 web roll groups
12 strand upper surface
13 strand displacement direction
14 cross-beam
15 front elongate roll frame region
16 rear elongate roll frame region
17 support
18 transverse deformation effecting means
18*a* controlled hydraulic piston-cylinder unit
18*b* piston rod
19 strand narrow side
20 cross-beam
21 end of the parallel elongate roll frames
22 end of the parallel elongate roll frames
23 tie rod
23*a* controlled hydraulic piston-cylinder unit
23*b* openings
24 slot-shaped openings
25 base frame

The invention claimed is:

1. A method of casting an immediately thereafter rolling of a preliminary section having a web and opposite flanges, with which the preliminary section is cast in a continuous casting mold and is deformed in a stand with backup rolls in a soft reduction area, characterized in that the preliminary section is precast in the continuous casting mold with a bulge on the flanges and the web, respectively, in that the bulges on the flanges and the web of the preliminary section are rolled flat in the soft reduction area so that the flange outer surfaces and the web surfaces are largely plane, and in that the bulges of surfaces of the preliminary section web and/or of the flange outer surfaces are formed as slightly curved outwardly, arcuate bulges extending substantially over an entire longitudinal extent of the preliminary section web and/or flanges.

2. A method of casting and an immediately thereafter rolling of a preliminary section having a web and opposite flanges with which the preliminary section is cast in a continuous casting mold and is deformed in a stand with backup rolls in a soft reduction area, characterized in that the preliminary section is precast in the continuous casting mold with a bulge on the flanges and on the web, respectively, in that the bulges on the flanges and the web of the preliminary section are rolled flat in the soft reduction area so that the flange outer surfaces and the web surfaces are largely plane, and in that the bulges of the web and flanges are formed, respectively, by outer surfaces (6*b*) of the web and outer surfaces (7*a*) of the flanges which form, respectively, an obtuse angle with each other.

3. A device for supporting, guiding and deforming a metal cast strand of a preliminary section having a web and opposite flanges in a continuous casting installation with soft reduction, wherein beneath a continuous casting mold, on opposite sides of the cast strand, opposite roll carriers are arranged rolls of which are in transport and/or deformation connection with the cast strand, characterized in that within a strand guide (4) in a solidification region (5) for soft reduction, a plurality of arranged one after another, support and deformation rolls (3) are sectionwise conically adjusted with respect to the preliminary section web (6) and/or the flanges (7) with an increasing, in a strand displacement direction (13), force for forming the bulges of surfaces of the preliminary section web and/or the flanges outer surfaces as slightly curved outwardly, arcuate bulges extending over an entire longitudinal extent of the preliminary section web and/or flanges; and in that a roll frame (8) for the strand upper surface (12) consists of elongate roll frames (8*a*) extending parallel to the strand displacement direction (13) and connected with each other by cross-beams (14), in that on the elongate roll frames (8*a*) in a front region (15) and a rear region (16), respective supports (17) for deformation effecting means (18) are provided.

4. A device according to claim 3, characterized in that a respective roll frame (8*b*) is formed for the strand narrow sides (19) and consisting of a pair (8) of elongate roll frames (8*a*) extending parallel to the strand upper side (12) and connected with each other per a cast strand side (1*a*; 1*b*) by a plurality of cross-beams (20) extending transverse to the strand displacement direction.

5. A device according to claim 3, characterized in that bulges (6*a*) on the preliminary section web (6) and/or the flange outer surfaces (7*a*), which were precast in the continuous casting mold, in the solidification region for soft reduction, are deformed into a finished preliminary section by a conical adjustment of one or more roll carriers (2).

6. A device according to claim 3, characterized in that a section of a plurality of arranged one after another, support and deformation rolls (3) forms an angularly adjustable roll frame (8).

7. A device according to claim 3, characterized in that the support and deformation rolls (3) in the roll frame (8) form, over a length of a soft reduction area (9), adjustable flange roll groups (10) for the flanges (7) of the cast strand (1).

8. A device according to claim 3, characterized in that the support and deformation rolls (3) in the roll frame (8) form, over a length of a soft reduction area (9), adjustable web roll groups (11) for the preliminary section web (6) of the cast strand (1).

9. A device according to claim 3, characterized in that the pairs (8*c*) of a parallel, narrow side roll frames (8*b*) of both strand sides (1*a*; 1*b*) have respective ends (21, 22) thereof connected by tie rods (23) extending transverse to the strand displacement direction (13).

10. A device according to claim 9, characterized in that the tie rods are formed of controlled hydraulic piston-cylinder units.

11. A device according to claim 9, characterized in that the transverse deformation effecting means consists of controlled piston-cylinder units (18*a*) piston rods (18*b*) of which extend through slot-shaped openings (24) of the parallel small-side roll frames (8*b*) and are secured to base frames (25).

* * * * *